United States Patent [19]

Chu

[11] Patent Number: 4,886,380

[45] Date of Patent: Dec. 12, 1989

[54] PIEZOELECTRIC CONTROLLED ELECTROMAGNETICALLY DRIVEN PRINTING

[75] Inventor: Mosi Chu, Setauket, N.Y.

[73] Assignee: Primages, Inc., Ronkonkoma, N.Y.

[21] Appl. No.: 91,835

[22] Filed: Sep. 1, 1987

[51] Int. Cl.[4] ..... B41J 3/10

[52] U.S. Cl. ..... 400/121; 400/56; 400/124; 101/93.48; 101/93.31

[58] Field of Search ..... 400/56, 121, 120, 119, 400/124; 101/93, 48, 93.31, 93.04

[56] References Cited

U.S. PATENT DOCUMENTS

| | | | |
|---|---|---|---|
| 3,139,820 | 7/1964 | Kittler | 101/93.31 |
| 3,924,528 | 12/1975 | Ludin | 101/93.48 |
| 4,129,390 | 12/1978 | Bigelow et al. | 400/121 |
| 4,173,927 | 11/1979 | van Kempen et al. | 400/56 |
| 4,174,908 | 11/1978 | Wehler | 400/56 |
| 4,188,133 | 2/1980 | Matsui | 400/121 |
| 4,191,483 | 3/1980 | Mueller | 400/368 |
| 4,327,638 | 5/1982 | Wasserman | 101/93.48 |
| 4,389,935 | 6/1983 | Aral | 400/120 |
| 4,392,423 | 7/1983 | Nakajima et al. | 101/93.48 |
| 4,397,573 | 8/1983 | Thiel | 400/122 |

FOREIGN PATENT DOCUMENTS

| | | | |
|---|---|---|---|
| 20468 | 2/1983 | Japan | 400/121 |
| 42065 | 3/1985 | Japan | 400/17 |
| 164852 | 7/1986 | Japan | 400/124 |
| 1322876 | 7/1973 | United Kingdom | 400/124 |

OTHER PUBLICATIONS

Lane et al., "No Walk Type Actuator . . . ", IBM Technical Disclosure Bullentin, vol. 27, No. 2. pp. 1105–1108, 7–84.

"Magnet restrictive Actuator", IBM Technical Disclosure Bullentin vol. 29, No. 6, pp. 2603–2604, 11–86.

*Primary Examiner*—William Pieprz

*Attorney, Agent, or Firm*—Roberts, Spiecens & Cohen

[57] ABSTRACT

Dot-matrix printer for printing on a paper resting against a platen includes a bendable piezoelectric lamina, means for fixedly supporting the bendable piezoelectric lamina along a first edge, a planar rerromagnetic member, means for operatively connecting the planar ferromagnetic member to the bendable piezoelectric lamina at a region remote from the first edge, a dot print element, means for mounting the dot element to be responsive to the movement of the bendable piezoelectric lamina in the region of the planar ferromagnetic member to extend along a line parallel to the plane of the planar ferromagnetic member, control means for generating first or second voltage signals for energizing the bendable piezoelectric lamina to cause the planar ferromagnetic member to assume a first or a second position, and electromagnetic means for applying a magnetic force on the planar ferromagnetic member such that only when the planar ferromagnetic member is not in the first position is there sufficient force exerted by the dot print element to print on the record medium.

13 Claims, 5 Drawing Sheets

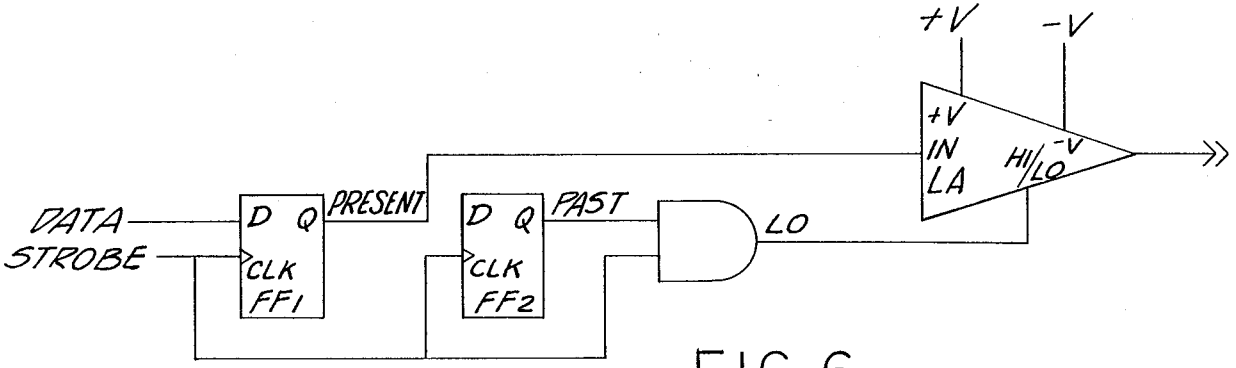
FIG. 6
DRIVER TRUTH TABLE
| IN | HI/LO | OUT |
|---|---|---|
| 1 | 0 | +V |
| 1 | 1 | <+V |
| 0 | X | -V |
X=IRREVELANT
FIG. 5B
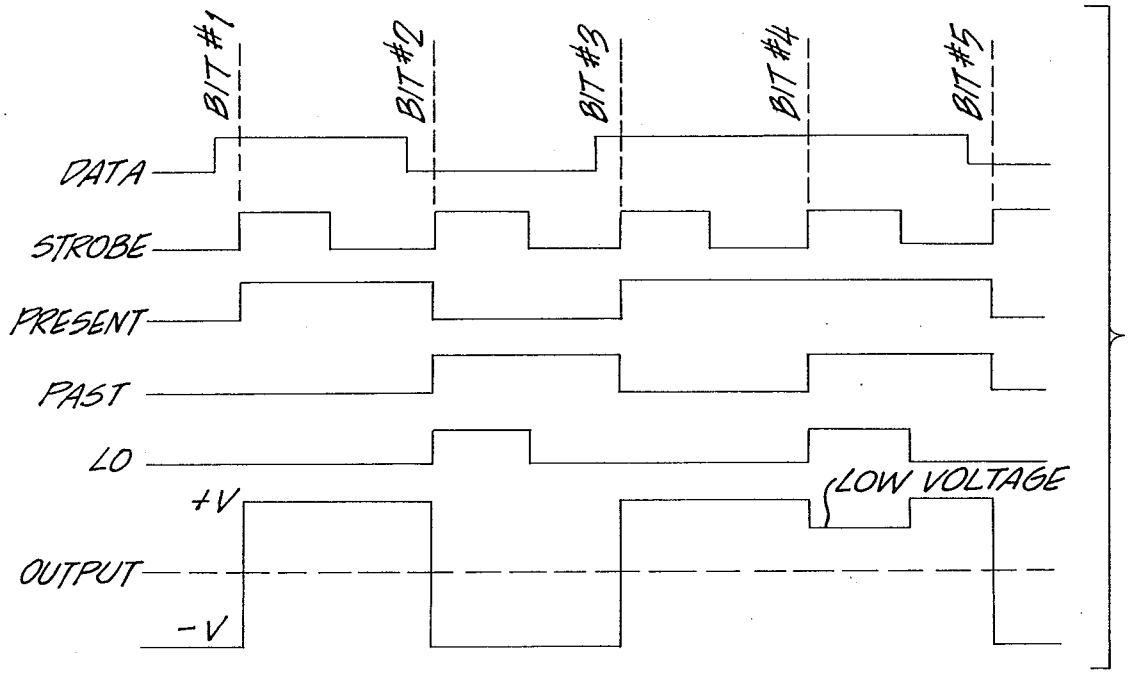
FIG. 5A

PIEZOELECTRIC CONTROLLED ELECTROMAGNETICALLY DRIVEN PRINTING

FIELD OF THE INVENTION

This invention relates to printing and more particularly to dot-matrix printers.

BACKGROUND OF THE INVENTION

Many printers are available today for use as output devices in data processing systems and the like. These printers fall into two general categories: non-impact printers, such as laser and thermal devices which are quiet but cannot be used for multicopy forms; and impact printers which can produce fully formed characters (daisy wheel) or arrays of dots (dot matrix) which can produce multiple copies on one pass, but which are noisy.

An example of a non-impact printer is shown in the Hilpert, et. al. patent No. 4,502,797. This patent teaches the use of electrodes to form dots on an electrosensitive paper. While such a device is quiet, the need for an electrosensitive record medium limits its practicality. The Lendl patent No. 4,174,182 is directed to a needle printing head, wherein a dot-matrix printer utilizes a camming operation to drive the print needles towards the paper. Print needles are selected by utilizing a piezoelectric brake which can controllably prevent selected ones of the print needles from reaching the record medium. Such a device is noisy because the print needles are fired towards the record medium in the usual manner, thereby creating impact noise. The same noise problem exists in the Goloby patent No. 4,167,343 wherein the combination of an electromagnetic force and stored torsional energy fire print needles toward a record medium. An example of non-electromagnetic printer is shown in the Kolm patent No. 4,420,266 which is directed to a piezoelectric printer. This printer because it relies entirely on the piezoelectric phenomena to perform impact printing is both noisy and has a complex and expensive layered piezoelectric structure.

SUMMARY OF THE INVENTION

It is accordingly an object of the invention to provide an improved method and apparatus for performing printing and especially dot-matrix impression printing.

It is another object of the invention to provide an improved method and apparatus which, while performing impression printing, is extremely quiet.

Briefly, a primary aspect of the invention is to provide for printing a dot on a record medium which rests on a platen and before which is a pigment bearing medium such as a ribbon. The method contemplates selectively positioning a print module which includes a dot print element carried by ferromagnetic member in a first position or a second position adjacent the media. When the module is in either of these positions a magnetic force is applied to the ferromagnetic member so as to urge the dot print element toward the media. The strength of the magnetic force is such that the dot print element is pressed against the media with sufficient pressure to cause the printing of a dot only when the print module is in the second position, usually the one closest to the media.

This aspect of the invention relies on the phenomenon of flat-faced tractive magnets. A discussion can be found in Art. 79, starting at page 229, of ELECTROMAGNETIC DEVICES by Herbert C. Roters, published by John Wiley & Sons, Inc. in 1941. This type of magnet is intended primarily to produce a large force through a relatively short stroke. Such magnets generally obey an inverse square law of distance, that is, the force exerted is inversely proportional to the square of the distance between the pole face of the magnet and the ferromagnetic body to be attracted. Accordingly, when the gap is very small, in the order of 0.01 inch, a tremendous force is exerted which can be used to press a dot print element sufficiently hard against the two media to print a dot. It should be noted that the travel distance of the dot print element can be extremely small; therefore minimal kinetic energy is needed to be dissipated at contact. Hence, there is virtually no impact noise. In a sense it can be said that magnet is "sucking" the dot print element toward the paper with pressure accomplishing the printing instead of firing the print element at the paper and relying on the impact to accomplish the printing.

In addition, this aspect of the invention needs a fast operating means to controllably bring the ferromagnetic member carrying the dot print element into and out of operative position for the action of an electromagnet. Accordingly, the invention further contemplates utilizing a bendable piezoelectric lamina to move the ferromagnetic member.

It is an object of another aspect of the invention to minimize even further any impact printing noise and increase the printing speed by minimizing the transit time and velocity of the dot print element.

This aspect of the invention contemplates measuring the thickness of the record medium and print ribbon, if any, and controlling the initial position of the dot print element with respect to the platen.

BRIEF DESCRIPTION OF THE DRAWING

Other objects, other features and the advantages of the invention will be apparent from the following detailed description of the invention when read in conjunction with the accompanying drawing.

In the drawing:

FIGS. 5A and B are respectively a waverform diagram and a driver truth table to aid in explaining operation of the printer of FIG. 2 and the circuit of FIG. 6.

FIG. 6 is a block diagram of apparatus for controlling the positioning the piezoelectric lamina.

DETAILED DESCRIPTION OF THE INVENTION

Figure 1:
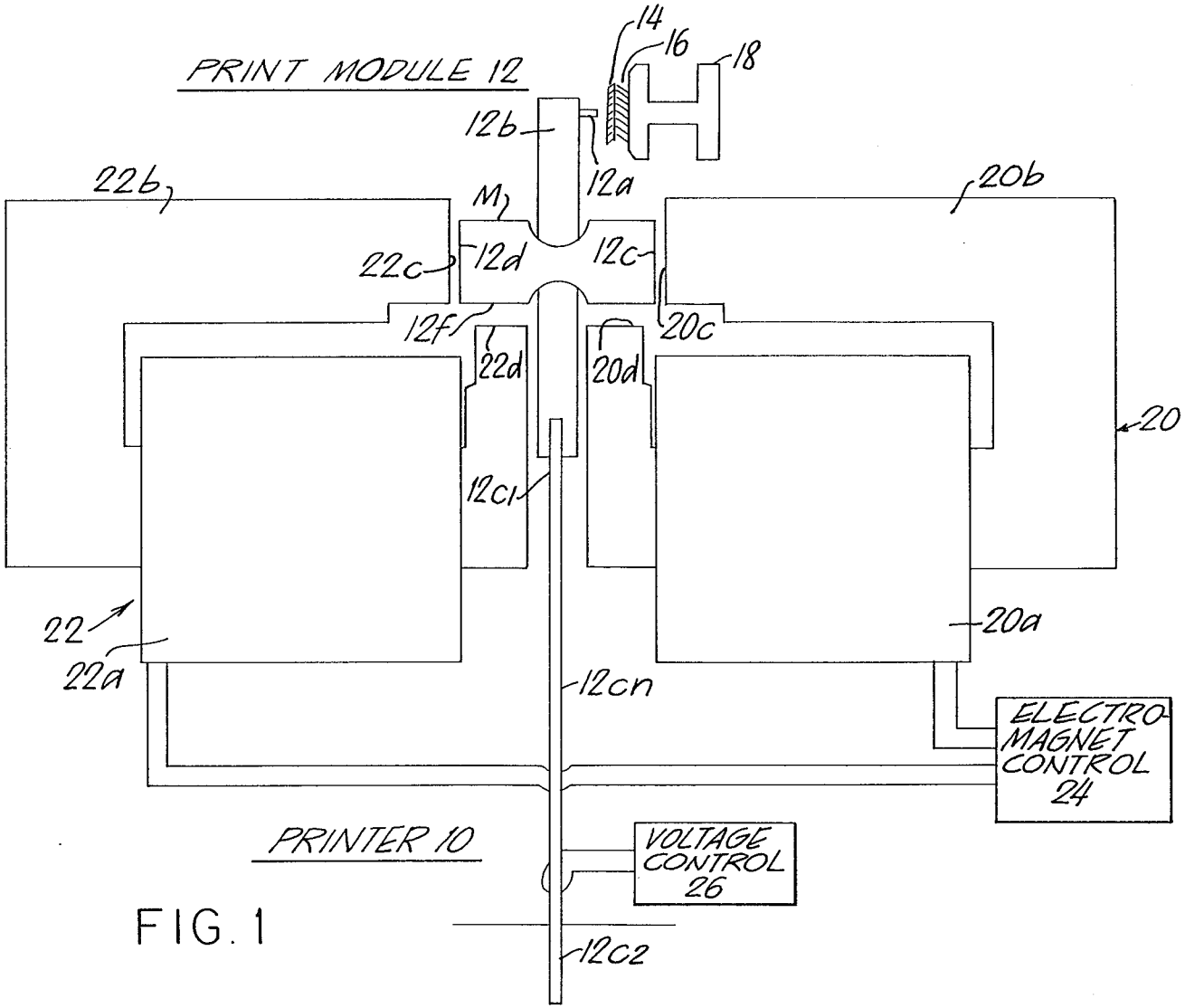
FIG. 1 is a laminar section through a printer in accordance one embodiment of the invention.

In FIG. 1 a printer 10 is shown including a plurality of dot print modules positioned opposite a print ribbon (pigment bearing medium) 16 that rests on a platen 18.

The print module 12 includes a dot print element 12*a* laterally extending from the region near one end of a plastic rod 12*b*, a sheet of bendable piezoelectric material or bendable piezoelectric lamina 12*cn* having one edge 12*c*1 connected to the other end of plastic rod 12*b*, and a planar ferromagnetic member M fixed to plastic rod 12*b* intermediate the ends thereof. The other edge 12c2 of bendable piezoelectric lamina is rigidly fixed to the body of the printer 10.

Opposite one end of planar ferromagnetic member M is a forward drive electromagnet 20. The electromagnet includes a coil or winding 20a about a core 20b with pole faces 20c and 20d. The core 20b is positioned such that the pole face 20c is opposite one side edge 12c of the planar ferromagnetic member M, whereas the other pole face 20d is opposite the bottom edge 12f of the planar ferromagnetic member M. Symmetrically on the other side of print module 12 is fixed the reverse drive electromagnet 22 of similar construction as forward drive magnet 20 (see coil 22a and core 22b with faces 22c and 22d). The coils of the electromagnets 20 and 22 are connected in parallel to an electromagnet control 24. In addition the bendable piezoelectric lamina 12cn is connected to the energizing voltage control 26. (The bendable piezoelectric lamina 12cn is of the bender type such that when a voltage is applied to different surfaces thereof the lamina will bend. Such devices are quite well known and are fully explained in the above-mentioned patent No. 4,420,266.)

In operation, if a positive voltage, by way of example, is applied across the bendable piezoelectric lamina 12cn by voltage control 26 the lamina 12cn will bend toward the right causing the planar ferromagnetic member M to move toward the pole face 20c of the electromagnet 20 and away from the pole face 22c of the electromagnet 22.

Then, when a current pulse is fed from the electromagnet control 24 simultaneously to both coils 20a and 22a, the very small gap between the pole face 20c and the planar ferromagnetic member M causes a pulling of the dot print module 12 to the right with a very strong force. This force is strong enough to create enough pressure by dot print element 12a against the media 14 and 16 for a dot to be printed. When the current pulse is removed, the voltage control 26 applies a voltage in the opposite direction moving the dot print module 12 toward the return drive electromagnet 22 (a rest position). If, however, the electromagnet current control 22 emits a pulse and the bendable piezoelectric lamina 12cn has not been moved from the rest position, there will be an attraction toward the return drive electromagnet and no dot will be printed.

Figure 2:
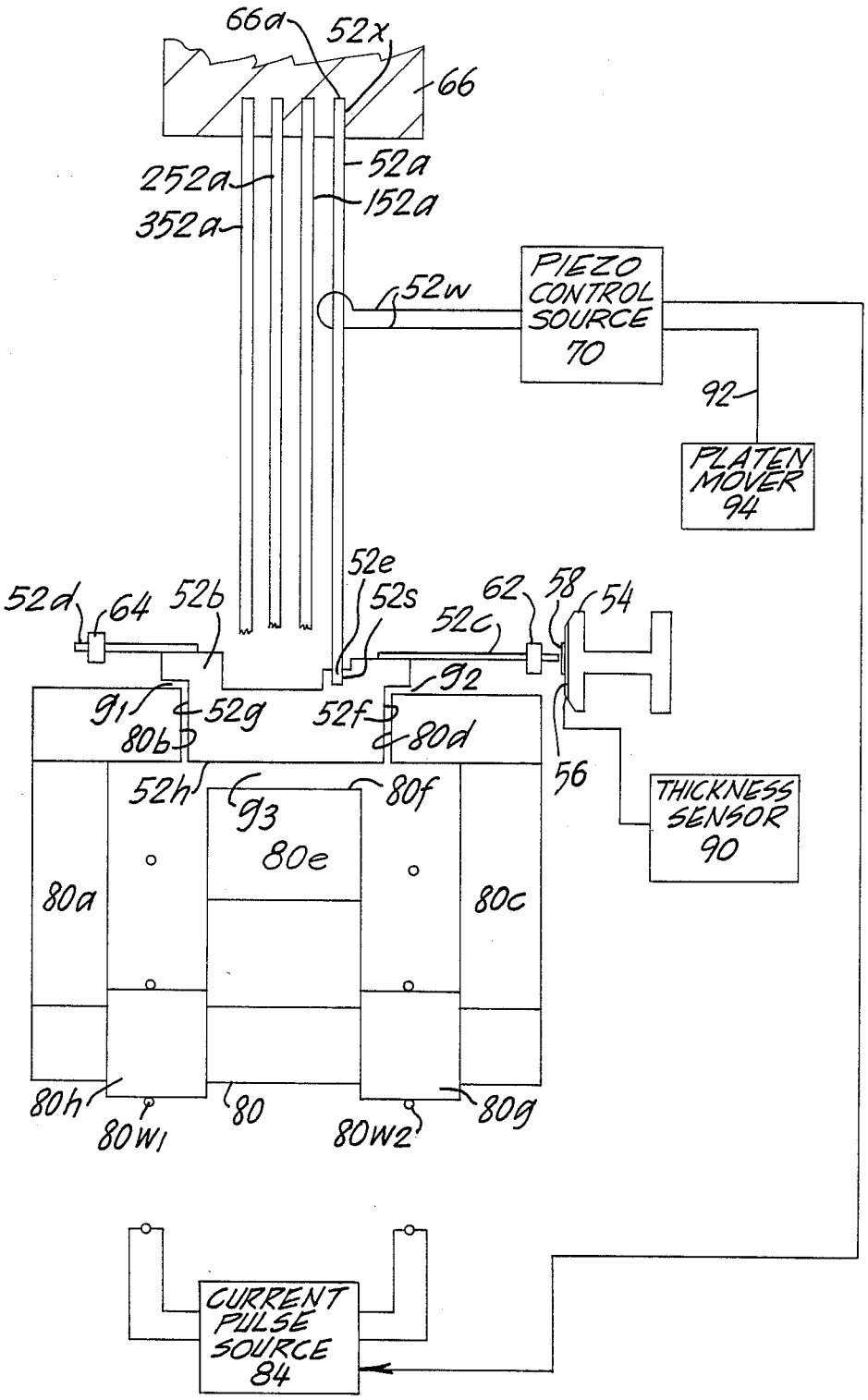
FIG. 2 is a cross-sectional view of a printer according to the preferred embodiment of the invention.

A second embodiment of the printer is shown in FIG. 2 including a plurality of dot print modules positioned opposite a platen 54 supporting a record medium 56 and a print ribbon 58. In particular the typical module (the only one shown in detail) includes the bendable piezoelectric lamina 52a of planar configuration, a planar ferromagnetic member 52b having a slot 52s which is engaged by the edge 52e of piezoelectric lamina 52a, and a dot print element 52c in the form of a wire soldered to the top edge of member 52b. Each bendable piezoelectric lamina is separately energized by piezo control signal source 70. For example, bendable piezoelectric lamina 52a (see also laminae 152a, 252a, 352a partially broken away) receives signals via leads 52w.

Figure 4:
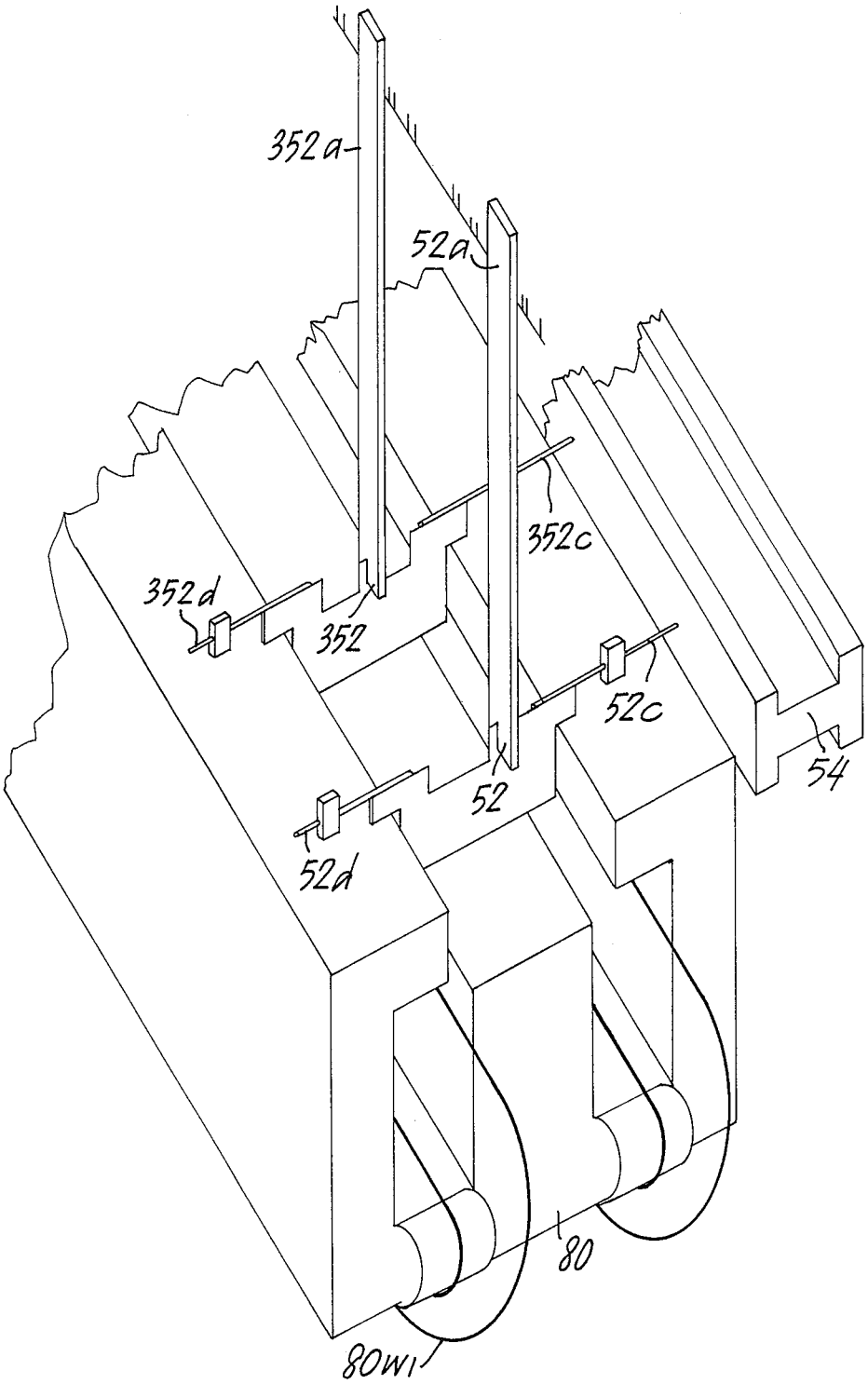
FIG. 4 is a perspective view of the print modules of the printer of FIG. 2.

Dot print module 52 and all the other dot print modules are fixedly supported in the printer in the following manner. The other edge 52x of the bendable piezoelectric lamina 52a is fixed in a groove 66a of support 6. Support 66 has a plurality of such grooves in spaced parallel relationship, each supporting one of the laminas so that they are arrayed in mutually spaced and parallel planes which are perpendicular to the plane of the drawing. See also FIG. 4.

The typical planar ferromagnetic member 52b is supported in the plane of the drawing by means of dot print element 52c passing through a guide hole in bearing block 62 and by guide wire 52d passing through a guide hole in bearing block 64. Each of the bearing blocks has a series of such holes spaced along a respective line perpendicular to the plane of the drawing so that the ferromagnetic members lie in mutually spaced and parallel planes which are orthogonal to the planes of the laminas. Furthermore, the side edges of the planar ferromagnetic members, such as edge 52f, lie in a common side plane, as do the side edges, such as edge 52g, lie in another common side plane and the bottom edges such as edge 52h lie in a further bottom edge plane. It should be noted that because of the spaced parallel array of the piezoelectric laminas, the slots such as slot 52s are at different distances from one of the common side planes.

Figure 3:
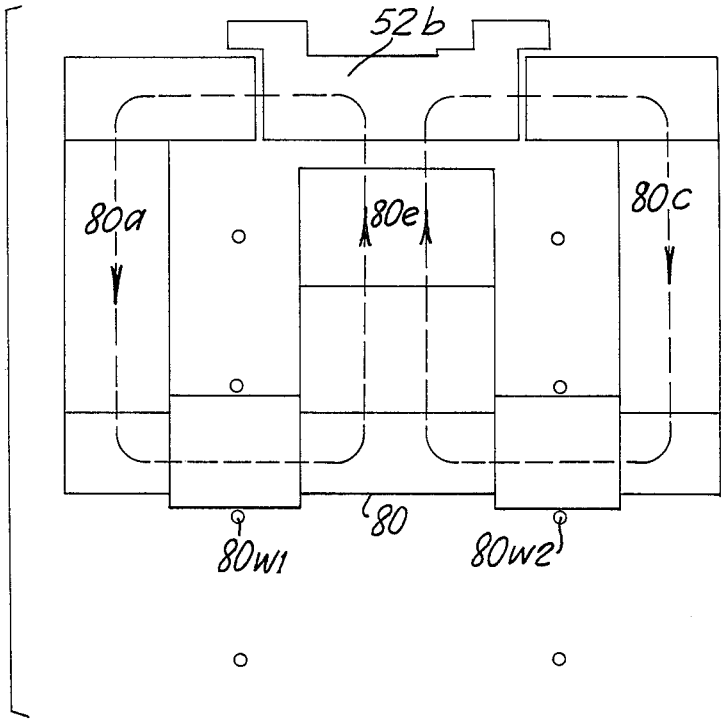
FIG. 3 is a schematic of the magnetic circuit used by the printer of FIG. 2.

A common electromagnetic driver 80 is positioned operatively adjacent all the dot print modules. The driver 80 includes an elongated iron core having an E-shaped cross-section and a pair of windings 80w1 and 80w2. The core has: a first outer arm section 80a with a pole face 80b opposite the common side plane of the edges such as edge 52g; a second outer arm section 80c with a pole face 80d opposite the common side plane of the edges such as edge 52f; a central arm section 80e with a pole face 80f opposite the common bottom plane of the bottom edges such as edge 52h; connecting section 80g about which winding 80w2 is wound and which magnetically connect arms 80c and 80e; and connecting section 80h about which winding 80w1 is wound and which magnetically connects arms 80a and 80e. The windings 80w1 and 80w2 are simultaneously energized by current pulses from current pulse source 84. In addition, to minimize interaction of the magnetic flux in the different circuits of the core, the coils are wound and energized so that the flux lines are in the same direction through the center arm 80e. See FIG. 3. Finally the core extends axially beyond the array of the dot print modules to insure that there is no fringing flux in the region of such modules.

Before starting the description of operation of the printer of this preferred embodiment it should be noted that the printer is provided with a paper thickness sensor 90. Sensor 90 can be a calibrated strain gauge which presses the record medium (paper) 56 against the platen 54 and emits a signal on line 92 to platen mover 94. The amplitude of the signal which is a function of the thickness of the medium 56 energizes mover 94 to move the face of the platen 54 to a predetermined distance from the ends of the dot print elements so that they will barely touch the ribbon 58.

The operating description will refer to FIGS. 2, 5 and 6 and will be directed to operation of only print module 52a as an example. The strobe pulses time the operation such that during the positive or first halves of the strobe pulses there will occur any ribbon or paper movement and during the negative or second halves of such pulses the electromagnets will be energized. Assume before bit time BIT1 dot print module will print a dot. Piezo control signal source 70 places a negative voltage signal on lines 52w. The bendable piezoelectric lamina 52a will bend toward the left. During the latter part of the bit period, current pulse source 84 emits a current pulse on the lines CP1 and CP2 causing the flux pattern shown in FIG. 3. Because of the bending of the lamina to the left, gap g1 is less than gap g2 and the ferromagnetic member 52b will be drawn against pole face 80b.

During bit time BIT1, assume the module is to print a dot as indicated by the high voltage on the DATA line. Flip-flop FF1 sets, raising the voltage on line PRESENT turning on logic amplifier LA. At this time flip-flop FF2 is not set so there is also a low voltage on line LO. Accordingly, piezo control signal source 70 sends a full positive voltage on line 52*w*. In response thereto piezoelectric lamina 52*b* bends to the right. Now the gap g2 opposite the edge of ferromagnetic member 52*b* is less than the gap g1. Hence when the current pulses are applied by current source 84, the member 52*b* is pulled to the right with the corresponding dot print element 52*c* strongly pushing print ribbon 58 against paper 56, resulting in the printing of a dot. For bit time BIT2, no dot is to be printed as indicated by the low signal on line DATA. Flip-flop FF1 is reset and flip-flop FF2 becomes set. The signal level on the PRESENT line drops turning off amplifier LA and in consequence the signal on line 52*w*. Note the pulse on line LO at this time is of no importance. The action of the print module is now the same as before bit time BIT1. During bit time BIT3, a dot is to be printed. The operation is identical to that of bit time BIT1. During bit time BIT4 another dot is to be printed. The operation is the same as that for the previous bit time, except that now both flip-flops are set because the printing of a dot is immediately preceeded by the printing of a dot. Therefore, to minimize print module travel it is only necessary to back the module off sufficiently to permit clearance of the ribbon while it moves during the first of a bit time. At this time the signal on line LO is high, as is the signal on line PRESENT. Amplifier LA is turned on, but the hi/lo input is also pulsed causing the amplifier to emit a lesser high voltage on line 52*w*. IN other words source 70 switches the voltage level on line 52*w* but also drops the level on line 52*w* by an amount related to the temporary clearance required for ribbon movement. When one is to print a successive dot there is no need to back off completely but only enough to permit some clearance. When the next current pulse is applied during the second half of the bit time, the gaps g2 opposite the edge of planar ferromagnetic member 52*b* closes and dot print element 52*c* is pressed against the ribbon 58 and paper 56.

It should be noted that when the number of print modules becomes large, it is preferrable to make the amplitude of the current pulses from the source 84 proportional to the number of print modules which are selected to print a dot at any given time, this in order to insure provision of sufficient magnetic force for all elements to be attracted strongly to the appropriate magnetic pole.

While only a limited number of embodiments have been shown and described in detail, there will now be obvious to those skilled in the art many modifications and variations such as substituting thermal bimetal benders for the piezoelectric laminas. However, this and other variations do not depart from the spirit of the invention as defined by the appended claims.

What is claimed is:

1. Dot-matrix printer comprising:

a platen for supporting a record medium;

a first print module, said first print module comprising a first module subassembly comprising a first bendable piezoelectric lamina having first and second edges, first mounting means for fixedly supporting said first bendable piezoelectric lamina along a region of said first edge, a first planar ferromagnetic member, first connecting means for operatively connecting said first planar ferromagnetic member to said first bendable piezoelectric lamina at a region remote from said first edge, and a first dot print element fixedly connected to said first module subassembly for following all movements of said first first bendable piezoelectric lamina;

a second print module, said second print module comprising a second module subassembly comprising a second bendable piezoelectric lamina having first and second edges, second mounting means for fixedly supporting said second bendable piezoelectric lamina along a region of said first edge, a second planar ferromagnetic member, second connecting means for operatively connecting said second planar ferromagnetic member to said second bendable piezoelectric lamina at a region remote from said first edge, and a second dot print element fixedly connected to said second module subassembly for following all movements of said second bendable piezoelectric lamina;

energizing means for selectively energizing selected of said bendable piezoelectric laminas to move between first and second positions; and common electromagnetic drive means positioned to apply a magnetic force directly to planar ferromagnetic members for attracting only those planar ferromagnetic members whose associated bendable piezoelectric lamina are in said second position toward said platen with sufficient pressure to cause dots to be printed by the dot print elements connected to those module subassemblies.

2. Dot-matrix printing module of claim 1 wherein the planes of said bendable piezoelectric laminas are mutually parallel and perdendicular to the planes of said planar ferromagnetic members which are mutually parallel, and said dot print elements are straight wires having axes parallel to the respective planes of said planar ferromagnetic members.

3. Dot-matrix printing module of claim 1 wherein said energizing means includes means for selectively energizing said bendable piezoelectric laminas individually between a fixed first position and a fixed second position or a fixed third position which is between said first and second positions, said third position being selected when a dot is to be printed immediately following the printing of a previous dot.

4. Dot-matrix printing module of claim 1 further comprising means for measuring the thickness of at least one of said media for establishing one of said positions as a function of said thickness.

5. Dot-matrix printing module of claim 1 wherein each of said planar ferromagnetic members has a similar edge provided with a slot to accept its associated bendable piezoelectric lamina.

6. Dot-matrix printing module of claim 5 wherein the slot of each planar ferromagnetic member is a different distance from a common plane.

7. Dot-matrix printer for printing selected dots on a record medium resting on a platen and before which is a pigment bearing medium, said printer comprising:

a plurality of dot print modules, each of said dot print modules including a ferromagnetic dot print means extending toward said platen and moving means for moving said ferromagnetic dot print means between a first postion operatively remote from and a second position operatively adjacent to said platen;

control means for selectively controlling said moving means to move selected ones of said ferromagnetic dot print means to said second positions respectively; and electromagnetic means positioned for simultaneously applying a magnetic force directly to all of said dot print modules but attracting only those ferromagnetic dot print means in said second positions against said media and platen with sufficient pressure to print a dot.

8. Dot-matrix printer of claim 7 further comprising means for measuring the thickness of at least one of said media for establishing one of said positions as a function of said thickness.

9. A method of selectively printing a dot on a record medium resting on a platen and before which record medium is a pigment bearing medium, said method comprising the steps of providing a print module with a dot print element extending toward said media and said platen, selectively moving said print module in a given direction toward said media and said platen between a first position and a second position, and applying a magnetic force directly to said print module for attracting said print module in said given direction toward said media and said platen so that said dot print element presses against said media with sufficient force to print a dot only when said print module is in said second position.

10. A method of selectively printing a dot on a record medium resting on a platen and operatively adjacent which record medium is a pigment bearing medium, said method comprising the steps of fixedly positioning a printing module including a flexible member carrying a ferromagnetic member and dot print element extending toward said platen, providing an electromagnet which when energized applys a magnetic force directly to said printing module for attracting said ferromagnetic member and said dot print element toward said media and said platen with sufficient pressure for said dot print element to print a dot only when said flexible member is in a given position, selectively bending said flexible member between a first and said given position, and energizing said electromagnet.

11. A method of claim 10 comprising piezoelectrically bending said flexible member.

12. A method of claim 10 wherein said selective bending step is the bending of said flexible member between a fixed first position and a fixed second or third position which is between said first and second positions and is a function of whether a dot had been previously been printed.

13. A method of claim 10 comprising measuring the thickness of at least one of said media and establishing one of said positions as a function of said thickness.

* * * * *